United States Patent [19]

Poix

[11] 3,943,701

[45] Mar. 16, 1976

[54] REGULATOR AND BALANCE BRIDGE ARRANGEMENT FOR A HOROLOGICAL DEVICE

[75] Inventor: Claude Louis Poix, Besancon, France

[73] Assignee: Timex Corporation, Waterbury, Conn.

[22] Filed: Jan. 8, 1975

[21] Appl. No.: 539,480

[52] U.S. Cl. ..... 58/109; 58/115

[51] Int. Cl.[2] ..... G04B 17/14; G04B 17/32

[58] Field of Search ..... 58/109–113, 58/115

[56] References Cited

UNITED STATES PATENTS

| | | | |
|---|---|---|---|
| 3,564,840 | 2/1971 | Meitinger | 58/109 |

FOREIGN PATENTS OR APPLICATIONS

| | | | |
|---|---|---|---|
| 141,934 | 8/1930 | Switzerland | 58/109 |
| 632,527 | 7/1956 | Canada | 58/109 |

*Primary Examiner*—George H. Miller, Jr.

[57] ABSTRACT

A horological device with a conventional balance wheel assembly, supporting bridge and hairspring with an adjustable regulator for the hairspring. The improvement comprises means for pinning the end of the hairspring to the bridge and a special bridge extension to retain the hairspring in the open regulator slot. In a first embodiment, the bridge extension is part of an integral bridge member. In the second embodiment, the bridge extension is pivotable to cover the regulator slot as well as to pin the hairspring to the bridge.

5 Claims, 5 Drawing Figures

REGULATOR AND BALANCE BRIDGE ARRANGEMENT FOR A HOROLOGICAL DEVICE

BACKGROUND OF THE INVENTION

This invention relates generally to horological devices with balance wheel assembly provided with a bridge, hairspring and adjustable regulator for the hairspring. More particularly, it relates to an improved bridge and regulator arrangement facilitating assembly of the components and providing simplifications in construction of a horological device.

Various constructions are known in the prior art for pinning the end of the hairspring to the balance bridge which supports the balance wheel assembly. Such arrangements are shown in U.S. Pat. No. 906,366 to Ball et al. in December 1908; U.S. Pat. No. 1,037,741 to Dudley in September 1912; U.S. Pat. No. 440,877 issued to Higginbotham in November 1890; U.S. Pat. No. 2,931,164 issued to Schweizer et al. in April 1960 and U.S. Pat. No. 3,154,912 to Pinkas in November 1964.

Timepieces are also known in the art which include adjustable regulators, usually pivotable from the balance bridge, which comprise arms having slots for receiving the hairspring at some distance from the pinning point, for the purpose of acting on the spring to regulate the characteristic of the balance wheel. The regulators have included various means of providing this regulating slot. For example, the aforementioned Pinkas patent includes a separate clip which must be assembled or disassembled from the regulator arm. Other regulators, as exemplified by U.S. Pat. No. 3,638,419 to Diersbock issued February 1972 and U.S. Pat. No. 3,517,503 to Smythe et al. issued June 1970 have employed completely enclosed regulator slots through which the end of the hairspring must be threaded before pinning in place. Other regulators, as exemplified by U.S. Pat. No. 3,564,840 to Meitinger issued February 1971 have employed open slots facing away from the balance bridge, which are easier to assemble but which offer the possibility of the hairspring being jolted or jarred out of the open end of the regulator slot.

It is desired to have a construction which is easy to assemble and yet which provides security of the hairspring pinning and retention of the hairspring within the regulator slot.

Accordingly, one object of the present invention is to provide an improved balance bridge and regulator arrangement for a horological device which permits ease of assembly and security of the hairspring.

Another object of the invention is to provide a simplified construction for the balance bridge and regulator in a horological device with a balance wheel assembly and a hairspring.

SUMMARY OF THE INVENTION

Briefly stated, the invention is practiced by providing in a horological device with a balance wheel assembly pivotably mounted in a balance bridge with a hairspring and an adjustable regulator, the improvement comprising an open slot in the regulator facing the bridge, a first portion of the bridge being adapted for pinning the hairspring and a second portion of the bridge having an extension extending over an arcuate section of the hairspring and closing off the open end of the regulator slot to prevent disengagement of the hairspring.

DRAWING

The invention will be more clearly understood by reference to the following description, taken in connection with the accompanying drawings, in which.

DESCRIPTION

Figure 1:
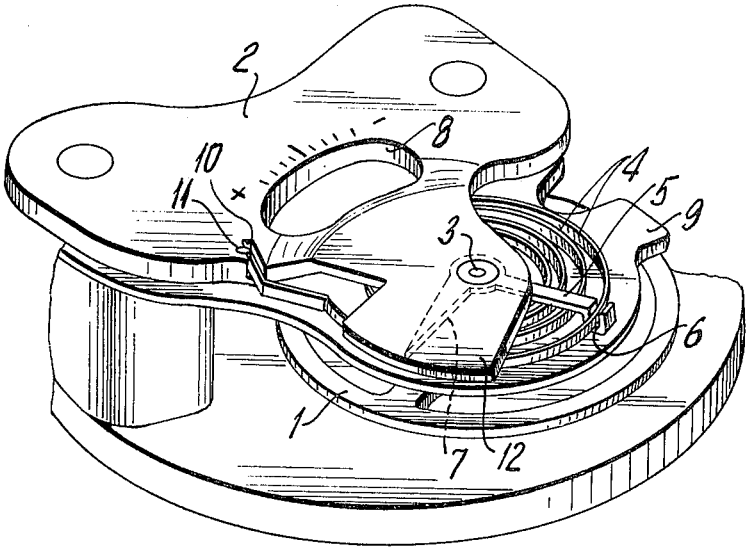
FIG. 1 is a partial perspective view of a first embodiment.

Referring to FIG. 1 of the drawing, portions are shown of a horological device, which in this case is an electric watch, although the invention is equally applicable to a mechanical watch. An oscillating balance wheel 1 is pivotably supported at its upper end by a balance bridge 2 via a conventional bearing 3. A conventional spiral hairspring 4 is attached at its inner end to the balance wheel hub, while it is attached at its outer end, by means to be described, to the balance bridge. A regulator arm 5 is pivotably mounted to the balance bridge so as to be adjustable and is formed at its outer end to define a slot 6 which opens upwardly toward the balance bridge 2. The regulator may also include an indicator 7 which when the regulator is rotated to the operating position, will be viewable through a window 8 in the balance bridge. In the case of an electric watch, a shunt bridge 9 may also be employed to control the magnetic flux, but it is not a part of the present invention.

According to the present invention, the balance bridge 2 has a first portion which includes a pinning slot 10 adapted to receive the free end of the hairspring 4, and a separate pinning member 11. The balance bridge 2 also includes a second special portion 12 which extends out over an arcuate section of the hairspring and covers the portion of the hairspring which will normally be occupied by the slot 6 of the regulator arm over the entire setting range of the regulator.

Figure 2:
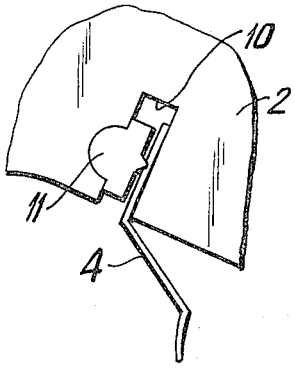
FIG. 2 is an enlarged partial view of the hairspring pinning provision.

FIG. 2 is an enlarged view of the first portion of the balance bridge illustrating that the free end of hairspring 4 is held in pinning slot 10 by a tapered vertically driven pin 11.

Figure 3:
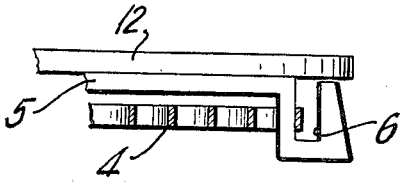
FIG. 3 is a horizontal cross section taken through the regulator arm.

Reference to FIG. 3 of the drawing illustrates a cross sectional view of the second portion of the balance bridge. As seen, extension 12 covers the open end of the regulator slot 6, thereby retaining the hairspring in the regulator slot. Slot 6 is proportioned in order to give a desired regulation characteristic of the balance wheel, an example of such arrangement being shown in the aforementioned U.S. Pat. No. 3,638,419 to Diersbock. The regulator may also include an additional adjustable arm for clamping the hairspring to adjust its effective length in accordance with the Diersbock patent.

Figure 4:
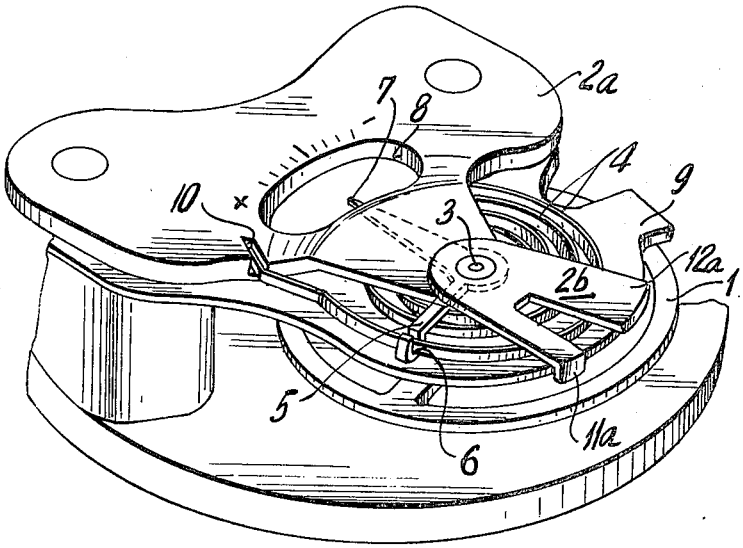
FIG. 4 is a perspective view of a second embodiment of the invention.
Figure 5:
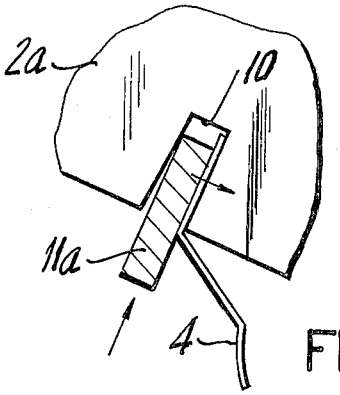
FIG. 5 is a view of the hairspring pinning point according to the second embodiment.

Referring to FIG. 4, a second embodiment of the invention is disclosed, wherein the same reference numerals are used for comparable elements as in the first embodiment. In this case, however, the balance bridge is made in two portions, a first fixed portion **2*a*** and a second pivotable portion 2*b*. The moveable bridge portion 2*b* includes an extension 12*a* which performs the same function as portion 12 in FIG. 1. The moveable bridge portion 2*b* also includes an arm with a downwardly extending tab 11*a*, which performs the same function as the comparable pin member 11 in FIG. 2. Reference to FIG. 5 illustrates how, when bridge portion 2*b* is pivoted, the tab 11a enters pinning slot 10 in the fixed bridge member 2*a*, pinning the end of the hairspring 4 in place. When the bridge member 2*b* is pivoted, portion 12*a* is located over an arcuate section of the hairspring so as to cover the open end of regulator slot 6 over the entire setting range of the regulator, and the cross-sectional view would appear the same as in FIG. 3.

OPERATION

Assembly of the components is effected in the following manner. In the embodiment of FIG. 1, the regulator arm 5 is moved out of its normal operating position to expose the open hairspring slot 6. The end of the hairspring is pinned by driving a tapered member 11 into place. Then the regulator arm 5 is moved to its normal operating position, whereby the open end of slot 6 is closed by balance bridge portion 12 to retain the hairspring.

In the second embodiment, after placing the hairspring in the position shown in the drawing of FIG. 4, with its free end in pinning slot 10 and within the regulator slot, the moveable portion 2*b* is pivoted, so that tab 11a pins the end of the hairspring and extension 12*a* covers the regulator slot.

While there has been described what is considered to be the preferred embodiments of the invention, other modifications will occur to those skilled in the art and it is desired to secure in the appended claims all such modifications as fall within the true spirit and scope of the invention.

I claim:

1. In a horological device with a balance wheel pivotably supported in a balance bridge and having a hairspring with one end thereof connected to the balance wheel and an adjustable regulator pivotably mounted on the balance bridge, the improvement comprising:
   - a regulator arm moveable relative to said bridge defining a regulator slot for holding the hairspring, said slot being open toward said balance bridge,
   - a first bridge portion providing a pinning slot for receiving the other end of the hairspring, and
   - a second bridge portion extending over an arcuate section of the hairspring and adapted to close off the open end of said regulator slot over the entire setting range of the regulator to prevent disengagement of the hairspring.

2. The combination according to claim 1, wherein said pinning slot is adapted to receive a separate pinning member and wherein said second portion is an integral section of the balance bridge.

3. The combination according to claim 1 wherein said hairspring is pressed against a flat surface of said pinning slot.

4. The combination according to claim 1, wherein said second bridge portion is a pivotable member carrying a tab for pinning the hairspring in the pinning slot and having an extension thereon for closing off the open end of the regulator slot when said second bridge portion is pivoted.

5. The combination according to claim 4, wherein said second bridge portion is pivotally mounted on the same axis as the balance wheel and the regulator and adapted for vertical assembly on the balance bridge.

* * * * *